United States Patent [19]

Nishimura

[11] Patent Number: 4,664,357

[45] Date of Patent: May 12, 1987

[54] OVERLOAD AVOIDING ARRANGEMENT FOR A HOIST

[75] Inventor: Yosaku Nishimura, Osaka, Japan

[73] Assignee: Vital Kogyo Kabushiki Kaisha, Osaka, Japan

[21] Appl. No.: 711,225

[22] Filed: Mar. 13, 1985

[30] Foreign Application Priority Data

Mar. 22, 1984 [JP] Japan ..... 59-55852

[51] Int. Cl.[4] ..... B66D 1/14

[52] U.S. Cl. ..... 254/351; 254/357; 254/358; 254/903

[58] Field of Search ..... 254/350, 351, 352, 353, 254/354, 357, 358, 368, 369, 903, 305; 192/16

[56] References Cited

U.S. PATENT DOCUMENTS

| | | | |
|---|---|---|---|
| 2,501,096 | 3/1950 | Robins et al. | 254/358 X |
| 3,741,527 | 6/1973 | Dahl | 254/350 |
| 4,251,060 | 2/1981 | Suzuki et al. | 254/356 |
| 4,348,011 | 9/1982 | Honda | 254/350 |

FOREIGN PATENT DOCUMENTS

| | | | |
|---|---|---|---|
| 731352 | 6/1955 | United Kingdom | 254/357 |

*Primary Examiner*—Stuart S. Levy
*Assistant Examiner*—Joseph J. Hail, III
*Attorney, Agent, or Firm*—Holman & Stern

[57] ABSTRACT

In a hand hoist in which a driven member 15 and a biasing drive member 16 are threaded onto a driving shaft 11, an overload avoiding arrangement for the hoist, which is so arranged that a manually rotated member 21 is supported by a support frictional surface 16*d* of the biasing drive member 16 and a frusto-conical frictional surface 22*b* of a frusto-conical friction member 22, while the frusto-conical friction member 22 unrotatably supported on the biasing drive member 16 so as to be displaceable in an axial direction, is depressed in the direction of the support frictional surface of the biasing drive member 16, by an adjustable nut 26 of the outer end of a boss 16*a* of the biasing drive member 16 and a belleville spring 23.

4 Claims, 3 Drawing Figures

OVERLOAD AVOIDING ARRANGEMENT FOR A HOIST

BACKGROUND OF THE INVENTION

The present invention generally relates to a winding machine and more particularly, to an overload avoiding arrangement for a winding machine such as a chain block, hand hoist or the like.

Generally, a winding machine is so constructed that a driven member and a brake biasing member coupled to each other through a friction member are fitted onto a driving shaft, thereby to transmit a rotational force applied to a manually rotated member to the driving shaft through said brake biasing member and said driven member. In the winding machine of the above described type, there has conventionally been proposed, for example, in U.S. Pat. No. 4,251,060 a winding machine provided with an overload avoiding arrangement which is so adapted that the rotation of the manually rotated member is not transmitted to the load side during overloading.

FIG. 1 shows the prior art as referred to above and so arranged that a retainer ring 3 is movably fitted onto a brake biasing member 2 for movement in the axial direction, while a friction transmission ring 5 is threaded onto said retainer ring 3, and onto an outer peripheral portion of the friction transmission ring 5, there is fitted a manually rotated member 6 having a frusto-conical inner surface 7 following a corresponding frusto-conical friction outer surface 4 of said friction transmission ring 5. On the other hand, the manually rotated member 6 is depressed so that its frusto-conical inner surface 7 closely contacts the frusto-conical friction outer surface 4 of the friction transmission ring 5, by belleville springs 9 fitted over an outer periphery of the retainer ring 3 and positioned by a spring support flange 8 of said retainer ring 3. Thus, it is so arranged that under the overloaded state of an object to be transferred, a rotational torque of the manually rotated member 6 necessary for the winding becomes larger than a frictional force produced by the belleville springs 9 between the manually rotated member 6 and the friction transmission ring 5, whereby the manually rotated member 6 is idly rotated to prevent the winding function.

However, in the known construction as described above, since the belleville springs 9 are held in direct contact with the spring support flange 8 at one end face of the manually rotated member 6, abrasion takes place on both of the belleville springs 9 and the spring support flange 8 at the end of the manually rotated member 6, with each idle rotation of said manually rotated member 6, thus resulting in deterioration of the apparatus.

By the abrasion of the belleville springs 9, the depressing force of said springs 9 is undesirably altered, and consequently, gives rise to such an inconvenience that the overload set value varies according to the frequency or the number of times for use of the winding machine.

Other disadvantages inherent in the above prior art arrangement are such that, since the manually rotated member 6 is only supported, at its one end face, by the belleville springs 9 in a state of linear contact, except that it is supported by the frusto-conical friction outer surface of the friction transmission ring 5, in the case, for example, where the manually rotated member 6 is constituted by a hand chain wheel as in a chain block, if the pulling operation of the hand chain is effected through deviation towards the side of the belleville springs 9, the contact between the hand chain wheel and the friction transmission ring 5 becomes loose, thus tending to result in such disadvantages that the hand chain wheel is idly rotated even with respect to a load smaller than a set overload value.

SUMMARY OF THE INVENTION

The present invention intends to solve the problems inherent in the prior art as described so far, and has for its object to provide an overload avoiding arrangement for a winding machine, which has less abrasion of various members employed, while a mechanical relation between a manually rotated member and a brake biasing member is stable in functioning.

It is another important object of the present invention to provide an overload avoiding arrangement of the above described type, which is simple in construction and accurate in functioning at high reliability.

According to one preferred embodiment of the present invention, there is provided an improved overload avoiding arrangement for a hoist, which is so arranged that, in a winding machine adapted to transmit rotation of a manually rotated member to a driving shaft through a biasing drive member and a driven member connected with the driving shaft, the driven member and the biasing drive member are coupled to each other through frictional members, a frusto-conical friction member is engaged, at its reduced diameter end portion, with a boss portion of the biasing drive member so as to be movable in the axial direction, while the manually rotated member having a frusto-conical inner surface following a frusto-conical friction outer surface of the frusto-conical friction member is fitted onto the outer surface of said frusto-conical friction member. The manually rotated member is supported by the frusto-conical friction outer surface of the frusto-conical friction member and an outer side frictional surface of said biasing drive member. Meanwhile, the frusto-conical friction member is depressed towards the biasing drive member by a belleville spring fitted onto the boss portion of said biasing drive member for positioning. Thus, in the case of overloading by a suspended load in which a rotational torque of the manually rotated member necessary for the winding, exceeds a frictional force given by said belleville spring between the manually rotated member and the frusto-conical friction member and/or the biasing drive member, the manually rotated member is idly rotated by overcoming the frictional force.

DESCRIPTION OF THE PREFERRED EMBODIMENT

Figure 1:
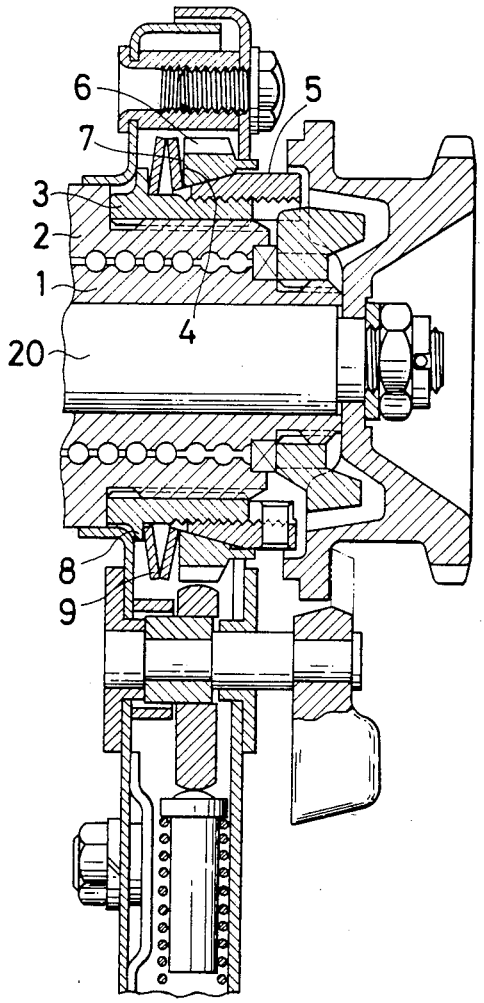
FIG. 1 PRIOR ART
FIG. 1 is a vertical sectional front elevational view of a prior art device.
Figure 2:
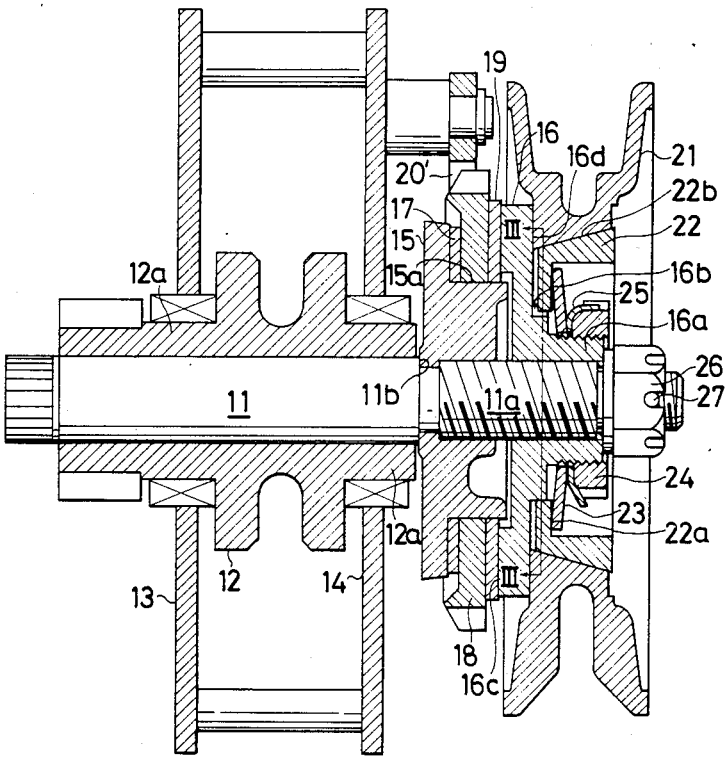
FIG. 2 is a vertical sectional front elevational view showing an overload avoiding arrangement according to the preferred embodiment of the present invention.
Figure 3:
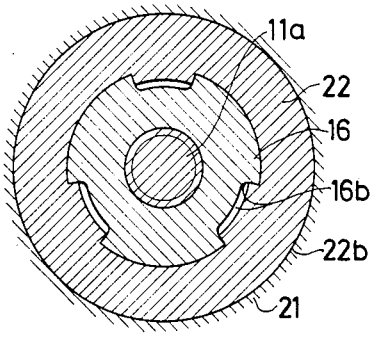
FIG. 3 is a cross section taken along the line III—III in FIG. 2.

Referring now to the drawings, there is shown in FIGS. 2 and 3, an overload avoiding arrangement as applied to a chain block, according to one preferred embodiment of the present invention. In FIG. 2, rotary shaft portions 12*a* of a load chain wheel 12 rotatably supported on a driving shaft 11, are journalled between a pair of side walls 13 and 14 constituting a chain block main body, while said driving shaft 11 and said load chain wheel 12 are coupled to each other through a known reduction gear mechanism (not shown).

One end of the driving shaft 11 is formed with a threaded portion 11*a*, with which a driven member 15 and a biasing driven member 16 are threadedly engaged. On the outer periphery of a boss portion 15*a* of the driven member 15, there are rotatably fitted a friction plate 17, a ratchet wheel 18 and another friction plate 19, with said ratchet wheel 18 being prevented from rotation in a reverse direction by a known reverse rotation prevention pawl 20' pivotally connected to the side wall 14, whereby it is so arranged that, when the biasing drive member 16 is rotated in a forward direction, said biasing drive member 16 depresses the friction plate 17, ratchet wheel 18, and friction plate 19 with respect to the driven member 15 by the lead of the threaded portion 11*a* of the driving shaft 11 for coupling of the biasing drive member 16 with the driven member 15 into one unit so that the driving shaft 11 is rotated therewith in the forward direction.

On a large diameter portion of a boss portion 16*a* of the biasing drive member 16 extending towards the end portion of the driving shaft 11, there are formed splines 16*b*. One end face of the biasing drive member 16 confronting the friction plate 19 is formed into a biasing frictional surface 16*c*, while the other end face thereof is formed into a support frictional surface 16*d* contacting a manually rotated member 21 to be described later.

To the large diameter portion of the boss portion 16*a* of said biasing drive member 16, a frusto-conical friction member 22 is fitted through splines, with its reduced diameter end being slightly spaced from the above support frictional surface 16*d*, so as to be movable in the axial direction. This frusto-conical friction member 22 is of a ring-like or annular configuration having an inwardly directed flange 22*a* at its reduced diameter and portion, and it is so arranged that said inwardly directed flange 22*a* is biased towards the support frictional surface 16*d* of the biasing drive member 16 by the belleville spring 23 fitted onto the reduced diameter portion of the boss 16*a* of the biasing drive member 16.

Onto the reduced diameter portion of the boss 16*a* of the biasing drive member 16, an adjusting and fixing nut 24 for positioning said belleville spring 23 is threaded, with a washer 25 being disposed between the nut 24 and the belleville spring 23, so that the biasing force of the belleville spring 23 with respect to the frusto-conical friction member 22 is adjustable according to the threaded positions of the nut 24. The frusto-conical outer surface of the frusto-conical friction member 22 is formed into an outer frictional surface 22*b* for supporting said manually rotated member 21. The manually rotated member 21 having its inner surface formed into a frusto-conical face following the above outer frictional surface 22*b* is fitted around the frusto-conical friction member 22, and thus, said manually rotated member 21 is supported by the outer frictional surface 22*b* of the frusto-conical friction member 22 and the support frictional surface 16*d* of the biasing drive member 16. A conventional hand chain (not particularly shown) is passed around the manually rotated member, and by pulling the hand chain for operation, a force for rotation in the forward direction or in the reverse rotation is imparted to the manually rotated member 21.

A nut 26 is threaded onto an extended end portion of the driving shaft 11, and is prevented from possible loosening by a retaining pin 27 inserted into the driving shaft 11. By this nut 26, the biasing drive member 16 is prevented from being moved towards the one end side of the driving shaft 11 beyond a predetermined degree. It is to be noted here that the fitting of the frusto-conical friction member 22 with respect to the biasing drive member 16 is not limited to the spline fitting as described above. It is needless to say that the construction may be so modified, for example, in such a manner that the frusto-conical friction member 22 is rotatably fitted onto the boss portion of the biasing drive member 16, and a hole extended through one end portion of said frusto-conical friction member 22 is fitted onto a guide pin axially projecting from the biasing drive member 16 so that the frusto-conical friction member 22 is movable only in the axial direction.

In the ordinary case, operations of the winding machine as described so far are effected in the manner as follows.

By the depressing or biasing force of the belleville spring 23, predetermined frictional forces are exerted between the outer frictional surface 22*b* of the frusto-conical friction member 22 and the inner surface of the manually rotated member 21, and also between the support frictional surface 16*d* of the biasing drive member 16 and the inner end face of the manually rotated member 21.

When the manually rotated member 21 is rotated in the winding up direction (i.e. forward rotation side) for raising the load by the pulling operation of the hand chain, the biasing drive member 16 is rotated following the rotation of the manually rotated member 21, and by the lead at the threaded portion 11*a* of the driving shaft 11, the friction plate 17, ratched wheel 18 and the friction plate 19 are pressed against the driven member 15, whereby the driven member 15 and the biasing drive member 16 are coupled to each other into one unit. Since the driven member 15 is prevented from rotation of a predetermined degree in the forward direction at a stepped portion 11*b* of the driving shaft 11, the rotation of the manually rotated member 21 is, after all, transmitted to the driving shaft 11, and the rotation of said driving shaft 11 is further transmitted to the load chain wheel 12 through a reduction gear mechanism (not shown). A load chain for suspending-loads (not particularly shown) is passed around the load chain wheel 12, thereby to raise the load.

When the manually rotated member 21 is rotated in the winding down direction (i.e. reverse rotation side) for lowering the load by operating the hand chain in the reverse direction to the previous case, the biasing drive member 16 is led, following the above rotation, towards the forward end side of the driving shaft 11, whereby the coupling with respect to the driven member 15 is released, and the driving shaft 11 is rotated in the reverse direction by the weight of the suspended load, and thus, the biasing drive member 16 is led towards the side for coupling with the driven member 15, and consequently, the lowering of the load is suspended by the action of the ratchet wheel 18 and the reverse rotation preventing pawl 20'. By repeating the above function, the lowering operation of loads is achieved.

Apart from the case for the normal operation as described so far, when it is intended to raise a load heavier than the predetermined load through rotation of the manually rotated member 21 by mistake, the result is such that the torque required for driving the manually rotated member 21 becomes larger than the depressing force of the frusto-conical friction member 22 with respect to the biasing drive member 16 by the spring force of the belleville spring 23 adjusted for the predetermined load.

Upon arrival at the above state, the state of close contact by the frictional contact of the support frictional surface 16*d* supporting the manually rotated member 21 and the frusto-conical friction member 22 at its frusto-conical frictional surface 22*b*, is lost, with only the manually rotated member 21 being idly rotated, and since the load can not be raised, an operator of the winding machine is informed that the machine was overloaded. More specifically, when it is intended to wind up, the manual rotating force applied to the manually rotated member 21 becomes larger than the frictional forces exerted between the frusto-conical friction member 22 and the manually rotated member 21 by the belleville spring 23, and also between the biasing drive member 16 and the manually rotated member 21, with a consequent idle rotation of the manually rotated member 21, and thus, the winding up in the overloaded state is not effected.

In the present invention having the construction as described so far, since the belleville spring 23 does not directly contact the manually rotated member 21, the belleville spring 23 is free from abrasion even during the idle rotation of the manually rotated member 21, and thus, is not altered in its restoring force (i.e. overloading set value) by the abrasion, whereby a stable using condition may be maintained for a long period.

Moreover, owing to the construction that the manually rotated member 21 is supported also by the support functional surface 16*d* of the biasing drive member 16, besides the outer frictional surface 22*b* of the frusto-conical friction member 22, the manually rotated member 21 is stabilized in its attitude. For example, even in the case where the hand chain is pulled to be derivated towards the driven member, there is no such an inconvenience that the manually rotated member 21 is inclined thereby towards the side of the driven member 15 so as to reduce the frictional force between the biasing drive member 16 and the frusto-conical friction member 22, thus causing the overload prevention function to be effected at a load smaller than a set overload. Furthermore, owing to the support by the outer frictional surface 22*b* and the support frictional surface 16*d*, even when the idle rotation takes place in the manually rotated member 21, the rotation braking thereafter is exerted comparatively effectively, and therefore, even in the case where the manually rotated member 21 is idly rotated during the winding up operation by the hand chain under the conditions in which a footing for the operator is not favorable, occurrence of a dangerous state, for example, where the operator loses a proper position, etc. may be advantageously avoided.

It is to be noted here that, if the construction in which the nut 24 is threaded onto the boss 16*a* of the biasing drive member 16 is in the foregoing embodiment, is adopted for the positioning of the belleville spring 23, adjustment of the set value for the overload can be extremely easily effected for the simplification of assembling work.

It should also be noted that, in the embodiment as described so far, although the present invention has been mainly described with reference to the chain block in which the raising or lowering of the objects is effected by the hand chain wheel, the arrangement of the present invention may of course be applied also be a hand hoist capable of causing the rotated member to rotate in the forward direction or in the reverse direction by a lever.

What is claimed is:

1. In a winding machine having a driven member and a biasing drive member coupled to each other by a friction member and threaded onto a driving shaft, thereby to transmit rotation of a manually rotated member to said driving shaft through said biasing drive member and driven member, an overload avoiding arrangement for the winding machine, which comprises a friction member having an outer frusto-conical friction surface, a smaller diameter end, a larger diameter end, a flange extending inwardly from the smaller end, and a drive connection between the flange and a boss portion of said biasing drive member, the drive connection preventing rotation between the friction member and the biasing drive member and permitting displacement of the friction member only in an axial direction, said manually rotated member having an inner surface of a frusto-conical shape mating with the frusto-conical friction surface of the friction member for support of said manually rotated member by the frusto-conical friction surface of said friction member, the manually rotated member further including a radial surface in direct frictional engagement with a radial friction surface of said biasing drive member, and the arrangement further including a belleville spring fitted onto a boss portion of said biasing drive member and engaging the flange of said friction member so as to press said friction member towards said biasing drive member.

2. An overload avoiding arrangement as claimed in claim 1, wherein said drive connection comprises splines provided on a large diameter boss portion of said biasing drive member and on said flange.

3. An overload avoiding arrangement as claimed in claim 1, wherein a nut for positioning and fixing said belleville spring is threaded onto a threaded portion of the boss portion of said biasing drive member.

4. An overload avoiding arrangement as claimed in claim 1, wherein said manually rotated member is a hand chain wheel.

* * * * *